US006209250B1

(12) United States Patent
Mills

(10) Patent No.: US 6,209,250 B1
(45) Date of Patent: Apr. 3, 2001

(54) SIDEARM CONVERTIBLE BETWEEN KNIFE AND FIREARM

(76) Inventor: William B. Mills, 65 E. Washington St., Apt. 4207, N. Attleboro, MA (US) 02760

( * ) Notice: Subject to any disclaimer, the term of this patent is extended or adjusted under 35 U.S.C. 154(b) by 0 days.

(21) Appl. No.: 09/218,055

(22) Filed: Dec. 21, 1998

(51) Int. Cl.[7] ..... F41C 27/16
(52) U.S. Cl. ..... 42/53; 42/106
(58) Field of Search ..... 42/1.09, 53, 90, 42/93, 106

(56) References Cited

U.S. PATENT DOCUMENTS

| | | | | |
|---|---|---|---|---|
| 481 | | 11/1837 | Lawton | 42/53 |
| 53,473 | | 3/1866 | Peavey | 42/106 |
| 626,472 | | 6/1899 | White | 42/53 |
| 688,548 | * | 12/1901 | Ricco | 42/1.09 |
| 752,893 | | 2/1904 | Evensen | 42/1.16 |
| 1,208,674 | | 12/1916 | Sidur | 42/53 |
| 1,238,527 | * | 8/1917 | Krasnodemski | 42/53 |
| 1,239,065 | * | 9/1917 | Wigiert | 42/53 |
| 1,263,440 | * | 4/1918 | Lenardic | 42/53 |
| 1,284,843 | * | 11/1918 | Werner | 42/53 |
| 1,298,920 | | 4/1919 | Farago | 42/53 |
| 1,316,664 | * | 9/1919 | Zadorozny | 42/90 |
| 1,333,268 | * | 3/1920 | Masaites | 42/106 |
| 1,515,751 | * | 11/1924 | Polhemus | 42/53 |
| 2,805,507 | | 9/1957 | Buquor | 42/53 |
| 2,823,481 | | 2/1958 | Walter | 42/93 |
| 3,530,580 | * | 9/1970 | Shelnick | 42/53 |
| 3,708,902 | | 1/1973 | Foster et al. | 42/106 |
| 3,755,948 | | 9/1973 | Heinicke | 42/17 |
| 3,879,878 | * | 4/1975 | Musgrave | 42/90 |
| 4,083,138 | | 4/1978 | Cash | 42/106 |
| 5,062,230 | * | 11/1991 | Braverman et al. | 42/1.09 |

FOREIGN PATENT DOCUMENTS

| | | | | |
|---|---|---|---|---|
| 3222001 | * | 12/1983 | (DE) | 42/1.09 |
| 3611485 | * | 10/1987 | (DE) . | |
| 2453384 | * | 10/1980 | (FR) | 42/1.09 |

OTHER PUBLICATIONS

"Chinese Knife Pistol—Deadly Duo or Toolroom Fantasy?", Jack Minnery, Soldier of Fortune, Dec. 1987.*

* cited by examiner

*Primary Examiner*—Darren W. Ark
(74) *Attorney, Agent, or Firm*—Barlow, Josephs & Holmes, Ltd.

(57) ABSTRACT

A convertible sidearm is provided which can convert easily between a firearm and a knife. The convertible sidearm includes a tubular body frame. A back plate member assembly is removably affixed to the tubular body at one end. The back plate assembly includes a plate member and a substantially tubular support member emanating outwardly from a planar surface of the plate member. A standard bolt or bolt carrier assembly from a primary firearm, having a bolt and a firing pin connected thereto, is inserted into the tubular support member of the back plate member assembly. A spring-loaded striker is positioned proximal to a firing pin within the bolt carrier assembly. A trigger communicates with the spring-loaded striker to release the striker toward the firing pin to fire the weapon. The firearm is easily converted to a knife by removing the barrel of the firearm and replacing it with a blade assembly and removing the bolt carrier assembly from the back plate member assembly and re-installing the back plate member within the tubular body member. Alternatively, the convertible sidearm may employ a permanent firing mechanism instead of a removable bolt or bolt carrier.

8 Claims, 17 Drawing Sheets

SIDEARM CONVERTIBLE BETWEEN KNIFE AND FIREARM

BACKGROUND OF THE INVENTION

The present invention relates generally to a convertible sidearm. More specifically, the present invention relates to a sidearm which is easily convertible between a knife and a firearm.

In the small arms industry, there has been a serious ongoing concern with reliability of firearms and the reduction of the overall number of weapons to be carried, particularly by military personnel. Since the mid-1960s, the armies of the world have standardized on automatic rifles which fire small caliber, high-velocity ammunition. These gas-operated firearms are prone to malfunctions and jamming, particularly when they have not been cleaned for extended periods of time, a condition which can be expected during actual combat conditions when it is not uncommon for weapons to go days without cleaning. For example, a rifle such as the U.S. 5.56 mm M16-A2, which has not been cleaned, can malfunction when its gas tube system clogs with gunpowder residue, or when grit, sand, or gunpowder residue accumulates in the upper receiver or chamber areas so as to cause a stuck bolt or cartridge. Modern rifles can also be disabled when struck with shrapnel or flying debris. Further, during the heat of battle, or when crossing difficult terrain such as a swamp or river, a soldier's rifle can be easily dropped and lost. When a soldier's rifle is disabled or lost in a combat area, the soldier is left defenseless and highly vulnerable.

In modem warfare, the soldier's bayonet does not make up for the loss of his or her shoulder weapon, as rarely do combat distances permit hand-to-hand combat. The modem bayonet has essentially become a utility knife, used primarily for cutting lines, wire, kindling wood, etc.

In view of the foregoing, attempts have been made in the prior art to address these concerns. Known prior art multi-use weapons are actually combination-type weapons in that they simultaneously provide different functions. For example, known designs include combination knife and pistol configurations where a pistol firearm mechanism, with associated barrel, is incorporated into knife handle which is complete with knife blade fully attached. In addition, prior combination weapon designs include concealed pistols within a knife handle or concealed knives within a pistol body. Such configurations for concealed weapons within the body of another weapon typically include a firearm assembly which is chambered for low-powered pistol type ammunition. Further, sights for such combination pistol and knife weapons were typically not included.

Therefore, in view of the concerns discussed above, it would be desirable for a knife or bayonet to be convertible into a single-shot pistol-type defense weapon for a soldier with a lost or damaged shoulder-weapon, which fires the standard rifle ammunition which the soldier would be carrying. The current world army standardization on small caliber, high velocity service rifle ammunition makes it possible for such a weapon offering dual-use of rifle ammunition to be manufactured, due to the lower recoil of present rifle cartridges such as U.S. 5.56 mm NATO. It is also desirable that such a weapon could provide the useful knife-type features of a bayonet, and with only a marginal addition in cost and weight. It is further desirable that this weapon be capable of employing the bolt assembly of a soldier's service rifle, during conversion into a firearm, to reduce the cost and weight of the convertible sidearm. This would result in a highly effective weapon for a soldier's defense until he has been able to either remove himself from the combat situation, repair his shoulder-weapon, or obtain a replacement shoulder weapon. In particular, a convertible knife pistol would be highly desirable and also enable a rifleman to remain armed while searching or exploring confined areas such as tunnels, "spider-holes", or enemy vehicles, in which a service rifle would be too large to employ effectively. A true convertible sidearm between a knife and a firearm would also be of great use as a survival weapon, or as part of a survival kit. Such a knife pistol would also permit a soldier, in a forward combat position, to remain defensively armed while cleaning his service rifle.

Still further, a convertible knife pistol would also provide benefits to police and security personnel, as well as outdoorsmen. Since there have been numerous incidents in which criminals have worn body armor, such as bullet-proof vests during the commission of a crime which cannot be pierced by the low-powered ammunition of a policeman's sidearm, the employment of a lightweight convertible weapon that can fire high-powered ammunition is highly desirable. Since the arming of every policeman with a high-powered rifle is neither practical nor cost-effective, a convertible knife pistol chambered for a high-velocity cartridge would enable law-enforcement officers to defeat criminals wearing such body armor. After the converted pistol has been fired, it may alternatively be used as a club or baton weapon also. In addition, campers and outdoorsmen often travel to desolate areas in which protection from large animals or potential wrong-doers is unavailable and to constantly carry a traditional firearm would prove impractical or cause unwanted attention. A weapon which is capable of converting between a knife and a high-powered firearm would prove advantageous to outdoorsmen as well.

SUMMARY OF THE INVENTION

The present invention preserves the advantages of prior sidearms. In addition, this sidearm provides new advantages not found in prior sidearms, and overcomes many of the disadvantages of such weapons.

The invention is generally directed to a novel and unique sidearm with particular application in situations requiring dual-use of a knife weapon that is convertible into a firearm capable of accommodating high-powered ammunition. The convertible sidearm of the present invention enables the quick and easy conversion between a knife weapon to a high-powered firearm while using many common parts to avoid excess components being carried by the user.

The preferred embodiment of the convertible weapon of the present invention includes a body frame of a substantially tubular configuration and which can be split into two halves to facilitate assembly, repair, and maintenance. A back plate member assembly is removably affixed to the tubular body frame at one end. The back plate assembly includes a plate member shaped like a knife pommel and a substantially tubular support member emanating outwardly from a surface of the plate member. A bolt carrier assembly, having a bolt and a firing pin connected thereto, resides within the tubular support member of the back plate member assembly. A spring-loaded striker is positioned proximal to the bolt and firing pin within the bolt carrier assembly. A trigger and sear engage with the spring-loaded striker to release the striker toward the firing pin to fire the weapon. The firearm is easily converted to a knife configuration by replacing the barrel of the firearm with a blade assembly and removing the bolt carrier assembly from the back plate member assembly and re-installing the back plate member within the tubular body member.

In operation, the invention easily converts between a firearm and a knife configuration. To assemble a knife, in accordance with the present invention, a blade assembly is first connected to the tubular body frame which also serves as the handle for the knife. The blade assembly is preferably retained in place by a locking collar. A back plate member is removably affixed to the tubular body at a first open end via a first connection such as by spring clips. In this condition, the construction is suitable for use as a knife weapon or knife tool.

To convert the weapon into a firearm, the blade assembly is first removed from the tubular body frame. A firearm barrel is affixed to the tubular body frame via a locking collar or other means at an opening in the tubular body frame. The back plate member assembly is removed from the opposite end of the tubular support member. A standard bolt or bolt carrier assembly, such as that of an M-16 rifle, is installed in the tubular support member of the back plate member assembly. A round of ammunition is then loaded into the chamber of the barrel via a cartridge port in the body frame. The combined bolt carrier and the back plate assembly are inserted into the tubular body frame to engage the sear with the striker of the bolt carrier assembly to effectively retract the striker in preparation for firing. The back plate is then secured to the tubular body frame by spring clips or the like.

A firearm trigger, which also serves as a knife guard when the construction is in a knife configuration, is depressed to disengage the sear from the striker to thereby cause the striker in the bolt carrier to urge the firing pin into the primer of the ammunition cartridge thus causing the ammunition to be fired. The spent cartridge body may then be ejected through the cartridge port to clear the chamber for additional rounds by withdrawing the bolt carrier and back plate assembly.

It is therefore an object of the present invention to provide a sidearm which may easily and quickly converted between a knife weapon or knife tool and a firearm.

An additional object of the present invention is to provide a convertible weapon that can provide a single shot pistol-type defense weapon.

Another object of the present invention is to provide a convertible weapon which provides a back-up weapon if a primary weapon fails.

It is another object of the present invention to provide a convertible weapon that utilizes parts or components of a primary weapon to reduce the overall weight that needs to be carried by a user and the overall cost of the weapon.

It is a further object of the present invention to provide a convertible weapon which provides a back-up firearm that can accommodate high-powered ammunition.

It is yet a further object of the present invention to provide a convertible sidearm with a knife blade for use as a weapon or useful tool.

It is another object of the present invention to provide a convertible weapon that accommodates high-powered ammunition in a small size.

It is a further object of the present invention to provide a convertible weapon that provides common use of components when in use as either a knife or a firearm.

It is an object to employ use of a knife scabbard as part of the convertible knife weapon system to reduce the possibility of loss of parts.

It is a further object of the present invention to provide a convertible weapon which makes use of a bolt assembly which locks directly to a barrel assembly to permit other components to be made of lightweight materials to reduce the weight of the weapon.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

The convertible sidearm of the present invention is a true convertible weapon in that it is assembled in either a firearm or a knife configuration. Unlike combination firearm and knife weapons, the convertible weapon of the present invention can only operate distinctly as a firearm or as a knife at a given time. Combination weapons, typically provide the capability to operate as a firearm and a knife simultaneously thus requiring fully operational components for both weapons at all times. As will be shown in detail below, the key critical differences between the convertible weapon of the present invention from prior known combination weapons is that the present invention includes an integral firearm mechanism which cannot operate as a handgun without removing the knife blade and replacing it with a barrel. Conversely, it cannot operate as a knife without replacing the firearm barrel with a blade assembly. In addition, the present invention provides a knife blade which is removed from the grip and a barrel is then attached which aligns and is co-axial with the contained firing mechanism. Further, due to the unique design of the convertible sidearm of the present invention, namely the employment of a locking bolt assembly, high-powered ammunition may be fired. Also, the convertible weapon of the present invention is not intended to be a concealed weapon as are most previous combination-type weapons. It also permits the capability for the firearm mechanism to utilize the bolt from another weapon, such as the U.S. M-16 rifle, when converted to fire ammunition.

Figure 1:
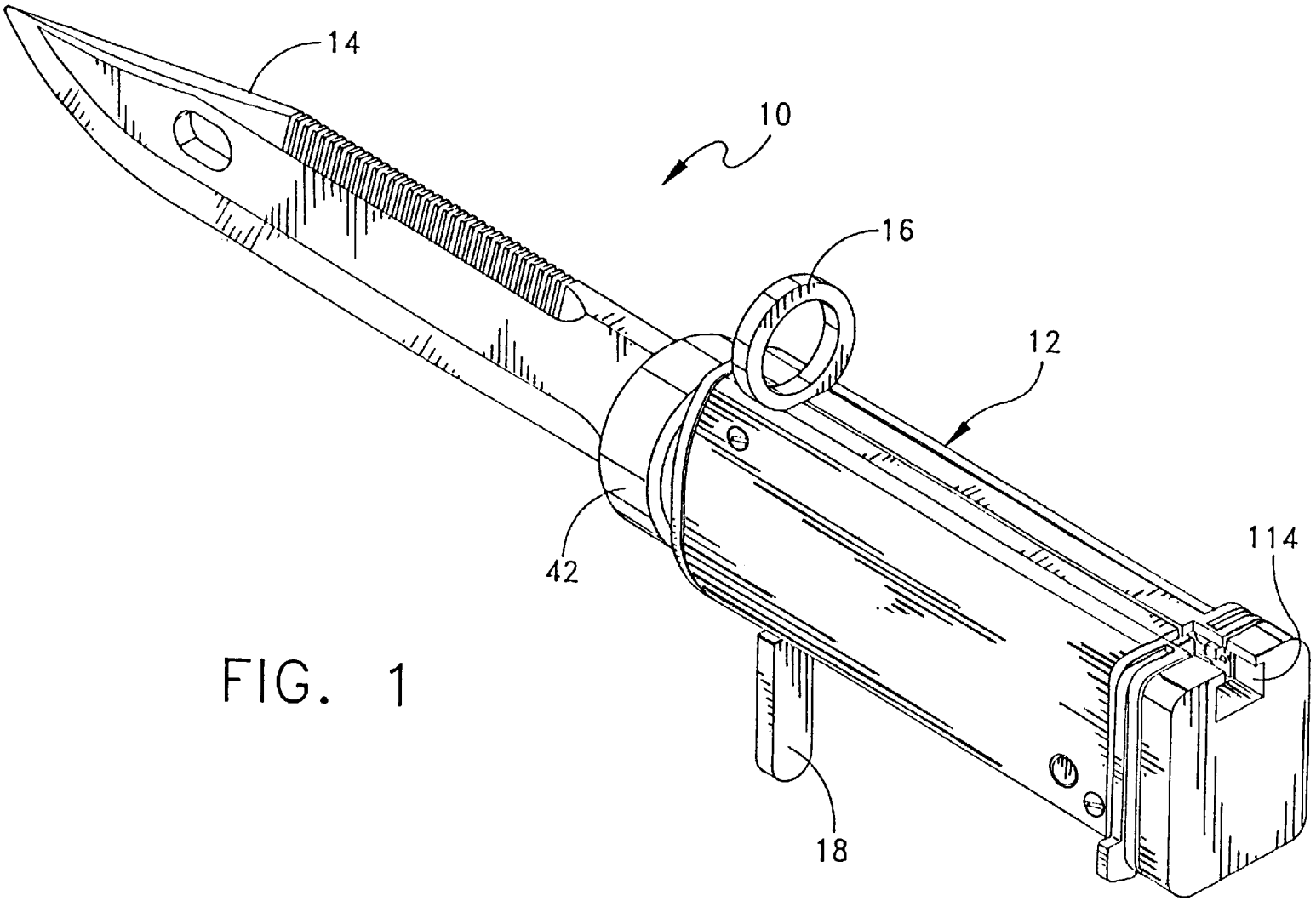
FIG. 1 is a perspective view of the convertible weapon of the present invention in a knife configuration.
Figure 2:
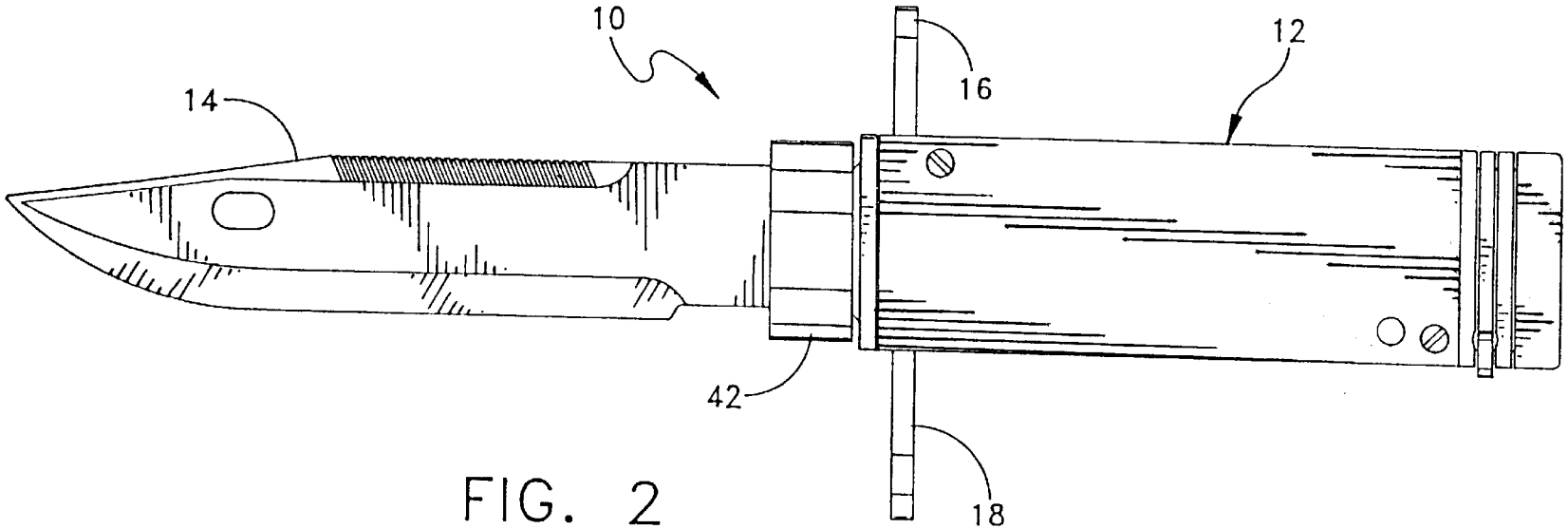
FIG. 2 is a front view of the convertible weapon shown in FIG. 1.
Figure 3:
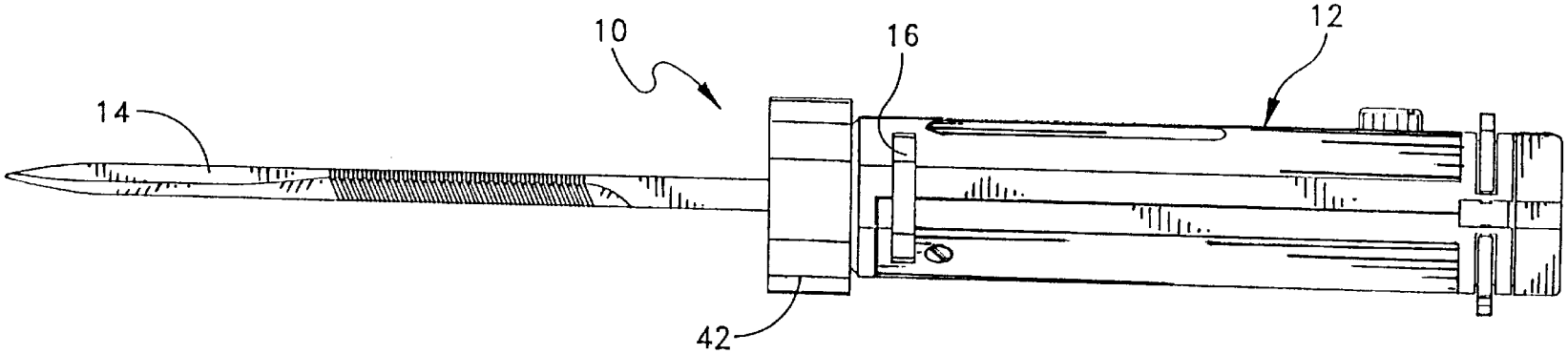
FIG. 3 is a top view of the convertible weapon shown in FIG. 1.
Figure 4:
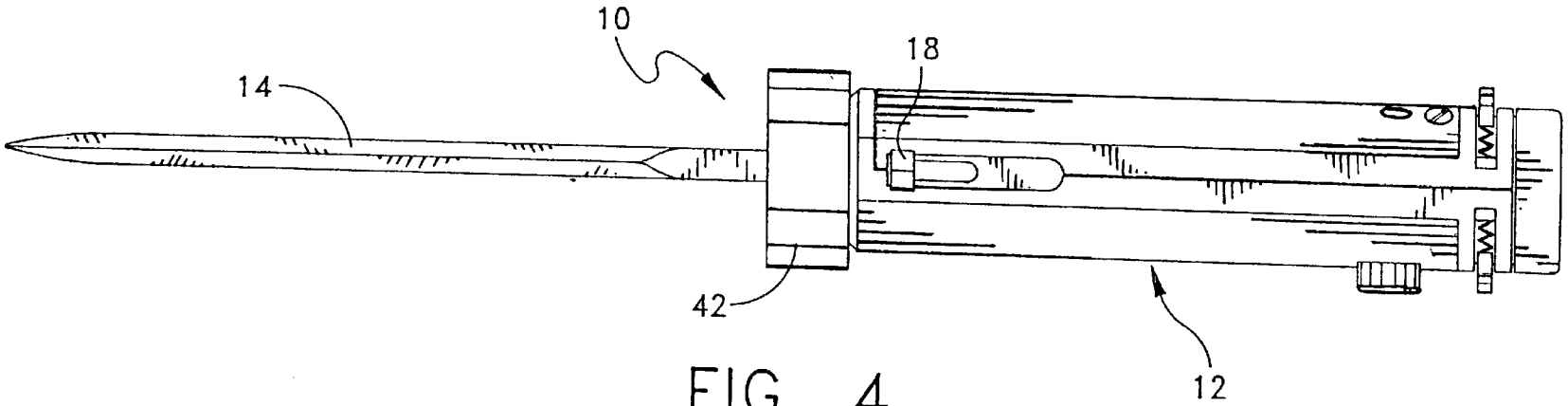
FIG. 4 is a bottom view of the convertible weapon shown in FIG. 1.
Figure 6:
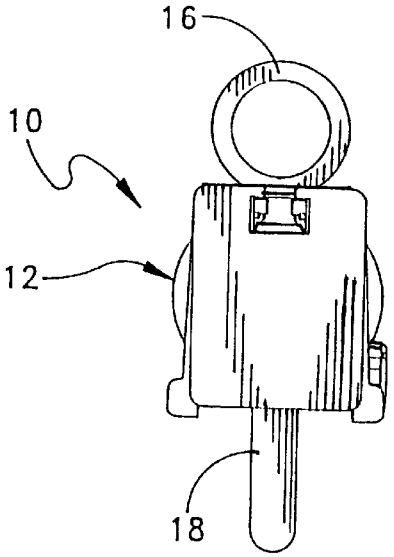
FIG. 6 is a right end view of the convertible weapon shown in FIG. 1.
Figure 5:
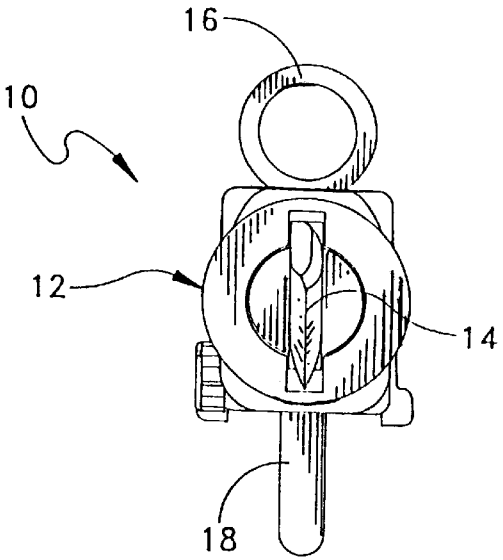
FIG. 5 is a left end view of the convertible weapon shown in FIG. 1.

Referring first to FIG. 1, a perspective view of the convertible sidearm 10 of the present invention is shown, particularly in its knife weapon or knife tool configuration. The invention consists of a firearm mechanism housed in a dual-purpose handle body which serves both as a knife handle and a firearm body or receiver. As will be described in detail below, the knife blade may be removed and a firearm barrel installed in place thereof to convert it into a firearm.

Now referring to FIGS. 1–6, the present invention 10 is shown in its general bayonet knife configuration which includes a dual-purpose body handle 12 and a blade member 14 connected thereto and held in place by a locking collar 42. Further, in the knife configuration shown in FIGS. 1–6, member 16 is a bayonet ring for attachment to a rifle barrel and member 18 serves as a knife guard. However, as will be described in detail below, these members also have specific firearm functions. For example, member 16 also serves as a firearm sight and member 18 serves as a trigger when the convertible weapon of the present invention is used in a firearm configuration. FIGS. 2–6 show respective front, top, bottom, left end and right end views of the convertible sidearm 10 of the present invention when configured as a knife. As can be readily understood, the knife configuration of the present invention can be used as a knife weapon or tool depending on the needs of the user at the present time. Due to the size, construction and configuration of the knife assembly, it will function equally well to a bayonet or knife which is of a non-convertible nature.

Figure 7:
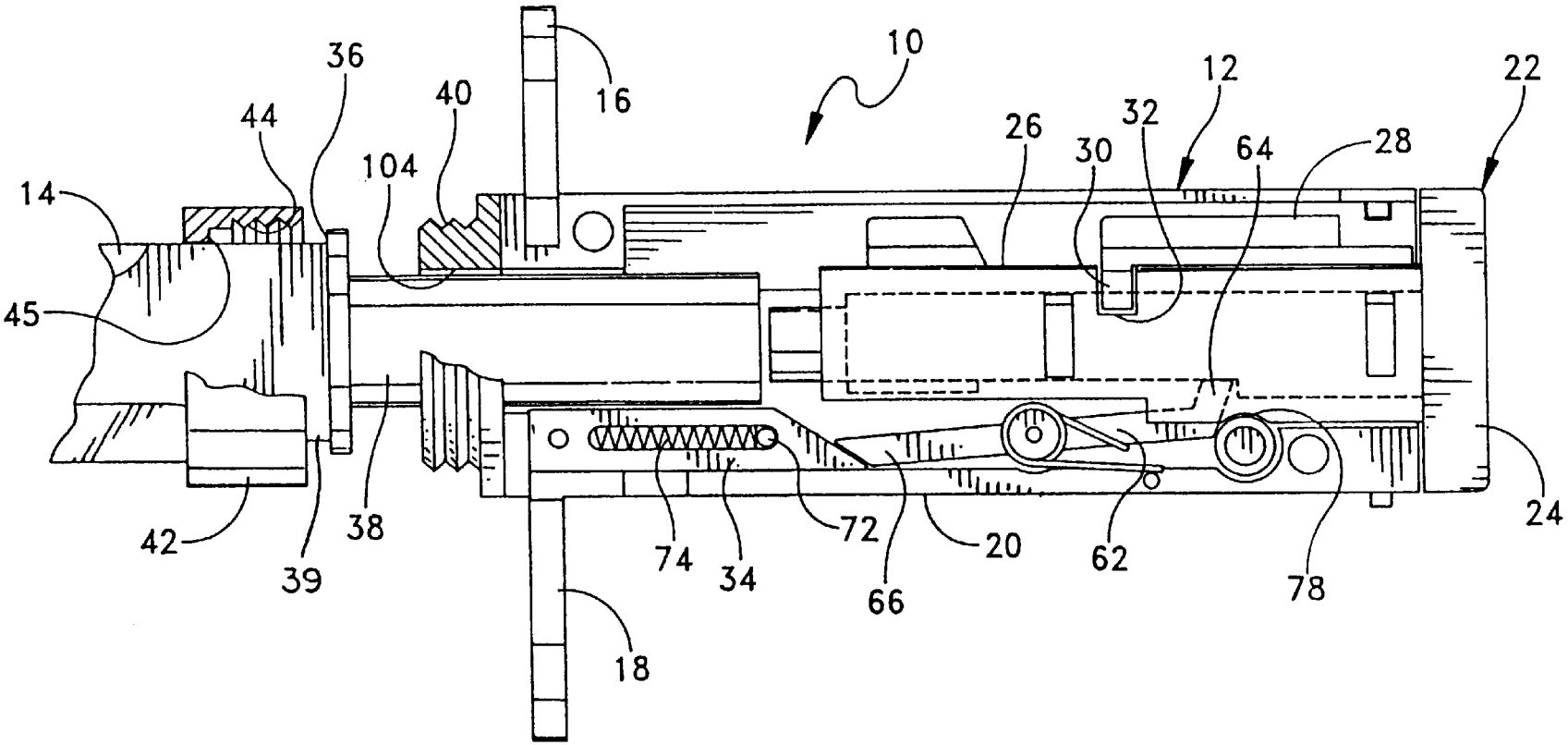
FIG. 7 is a front, partially cross-sectional view of the convertible weapon shown in FIG. 1 with blade portion partially installed.

Referring now to FIG. 7, details of the construction of the handle body 12 and interconnection of blade member 14 thereto is shown. In particular, blade member 14 is preferably provided with a knife base 38 and a flange 36 which is positioned about the circumference and behind the ricasso 39 of blade member 14. Preferably, handle body 12 also includes a male threaded neck 40 with a central bore 104 therethrough. To effectuate interconnection of blade member 14 to body handle 12 to complete the blade or knife configuration of the present invention, knife base 38 is inserted into central bore 104. Locking collar 42 is threaded onto male threaded neck 40 so that female threads 44 engage therewith and seat 45 engages flange 36 to effectively secure blade member 14 to handle body 12. It should be understood, however, that the foregoing locking collar attachment method is a preferred construction but other connection configurations may be employed, independently or in unison with the locking collar method, such as direct threads on the knife blade member 14 or bolting by means of push-pull pin type quick release fasteners. FIG. 7 further illustrates the general internal assembly within handle body 12 and particularly how it is unused and undisturbed when the convertible sidearm 10 is configured as a knife. The internal firearm mechanism is only used when the convertible sidearm 10 of the present invention is configured as a firearm.

Figure 8:
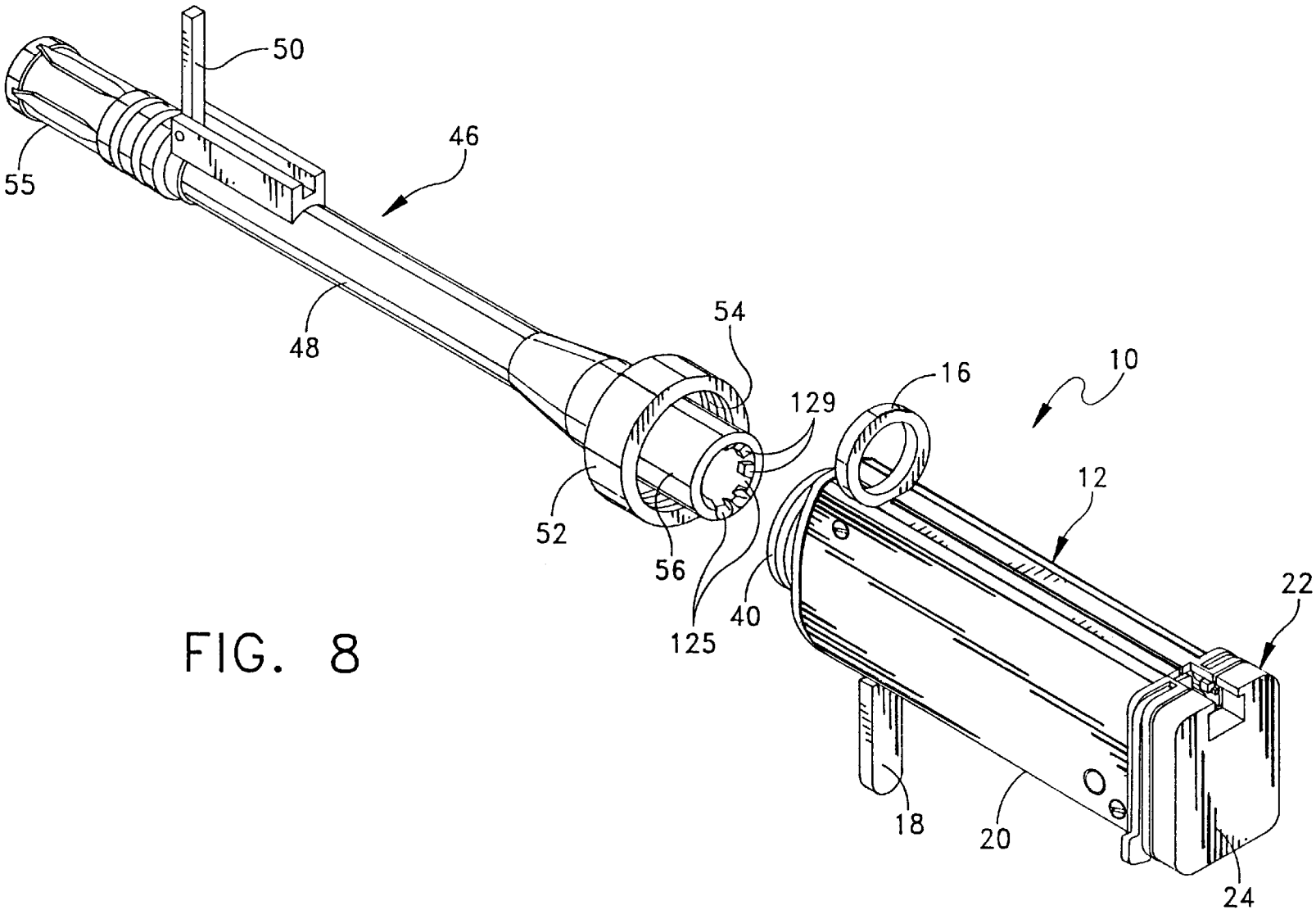
FIG. 8 is a perspective view of the convertible weapon of the present invention of FIG. 1 being converted into a firearm.

Referring now to FIGS. 8–18, the conversion of the convertible weapon 10 of the present invention into a firearm weapon, and the use thereof, is shown and described in detail. Referring first to FIG. 8, a perspective view of the convertible weapon 10 of the present invention is shown to include handle body 12, which is the same handle body 12 shown in FIGS. 1–7, but is now to be used in the firearm configuration of the present invention. To convert the weapon from a knife assembly to a firearm, the blade member 14 is disconnected from the handle body 12 by disengaging locking collar 42 from male threaded neck 40 thereby permitting knife base 38 to be removed from bore 104. FIG. 8 specifically illustrates the installation of a firearm barrel 46 in place of the blade member 14 of the knife configuration of the present invention. In similar fashion to the blade member 14, firearm barrel 46 employs locking collar 52 with female threads 54 thereon for engaging with male threaded neck 40. The firearm barrel 46 includes a base 56 which is installable within the bore 104 shown in FIG. 7. In similar fashion to the blade member, barrel 46 is preferably secured in place via locking collar 52 and may employ other attachment methods as discussed above. In addition, firearm barrel 46 may optionally include a flip-up front sight 50 and flash suppressor 55. In addition, channels 125 and abutments 129 in barrel 46, are provided to receive and engage a bolt, as will be described below.

Figure 12:
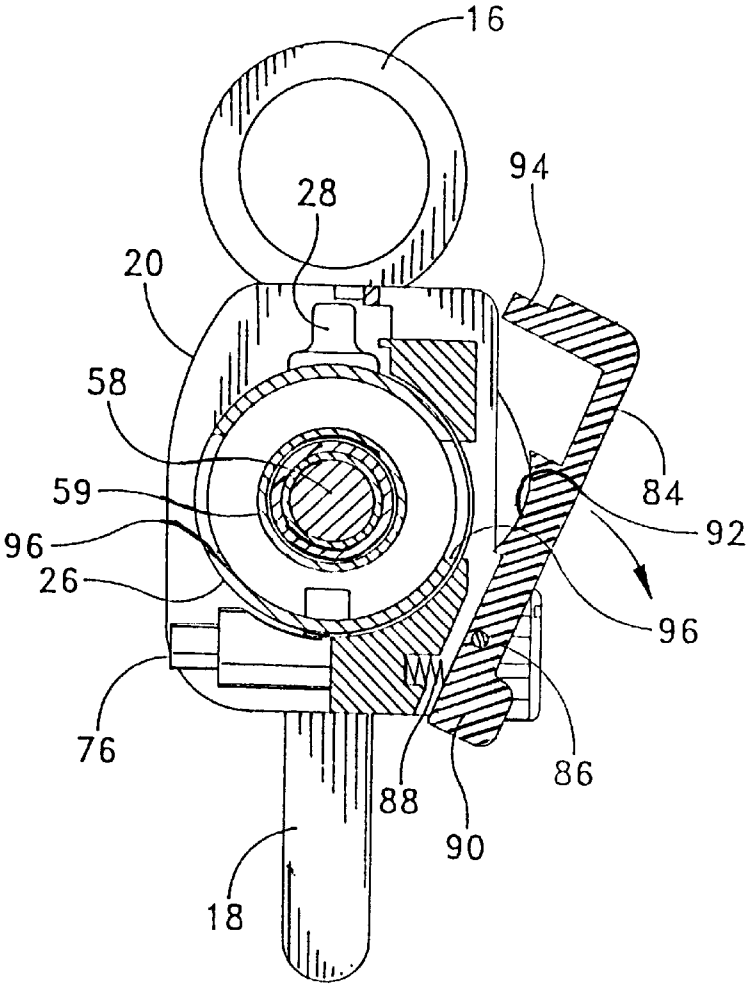
FIG. 12 is the cross-sectional view of FIG. 11 illustrating spring-biased release of the side clips of the body frame in accordance with the present invention.
Figure 13:
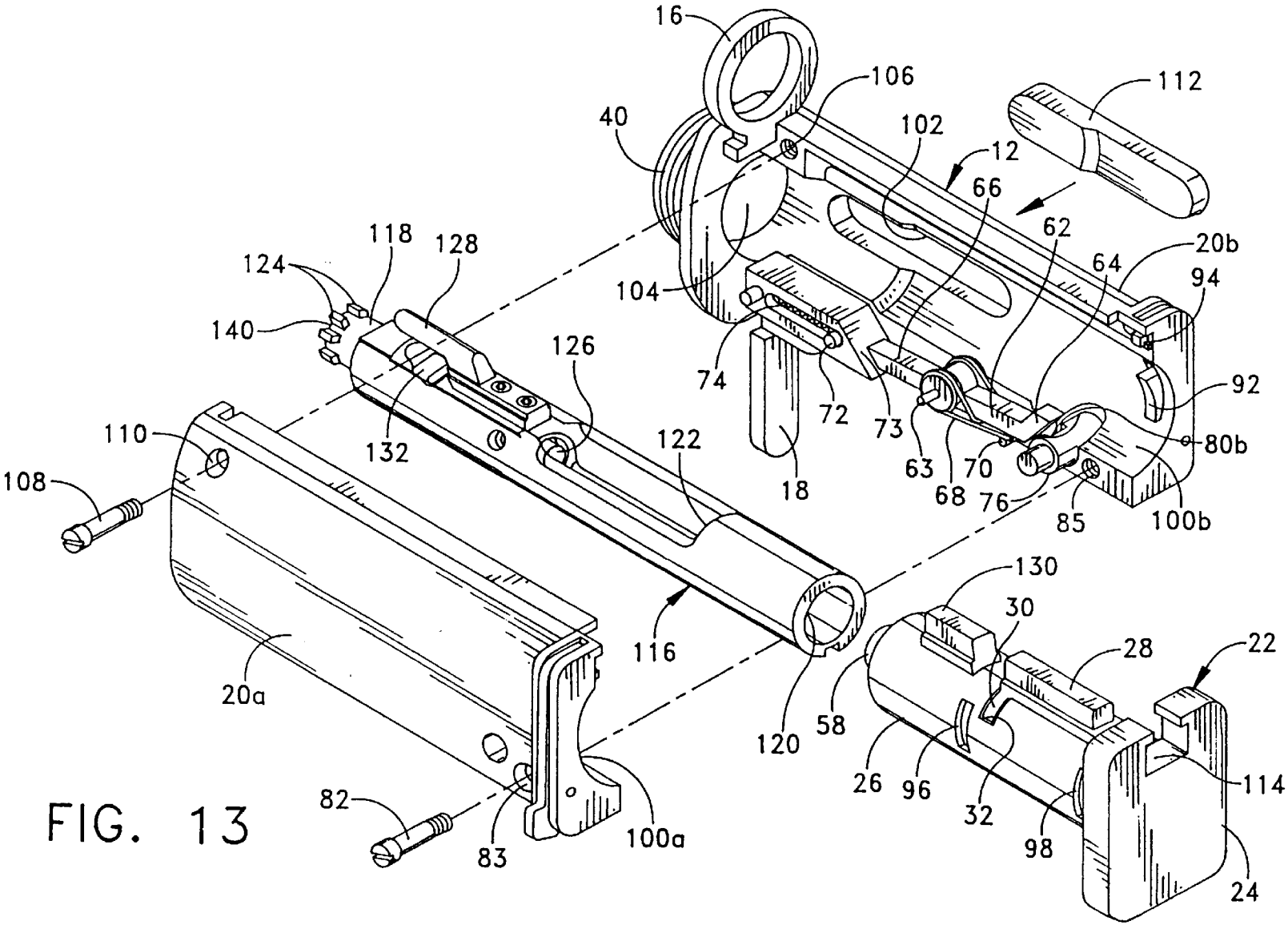
FIG. 13 is an exploded perspective view of the entire firing assembly in accordance with the present invention.

Referring now to FIGS. 9–13, the internal assembly of handle body 12 is shown. FIG. 13 illustrates an exploded perspective view of the internal assembly of handle body 12. In particular, a substantially tubular body frame, generally referred as 20, is provided with a left half frame **20*a* and a mating right half frame 20*b* which are secured together via fasteners 82, 108 and respective female threaded apertures 85 and 106 on right frame 20*b*. Fasteners 82 and 108 pass through respective apertures 83 and 110 in left frame 20*a* to engage with female threaded apertures 85 and 106. The right frame 20*b* carries trigger assembly 34, sear assembly 62 and safety mechanism 76. A cartridge insertion and ejection port 102 is provided within the side wall of right frame 20*b* which also receives a removable port cover 112. A bayonet ring now acting as a rear firearm sight 16, as earlier discussed, is provided at the upper edge of right frame 20*b* for sighting purposes during firing of the convertible weapon 10** of the present invention.

Figure 9:
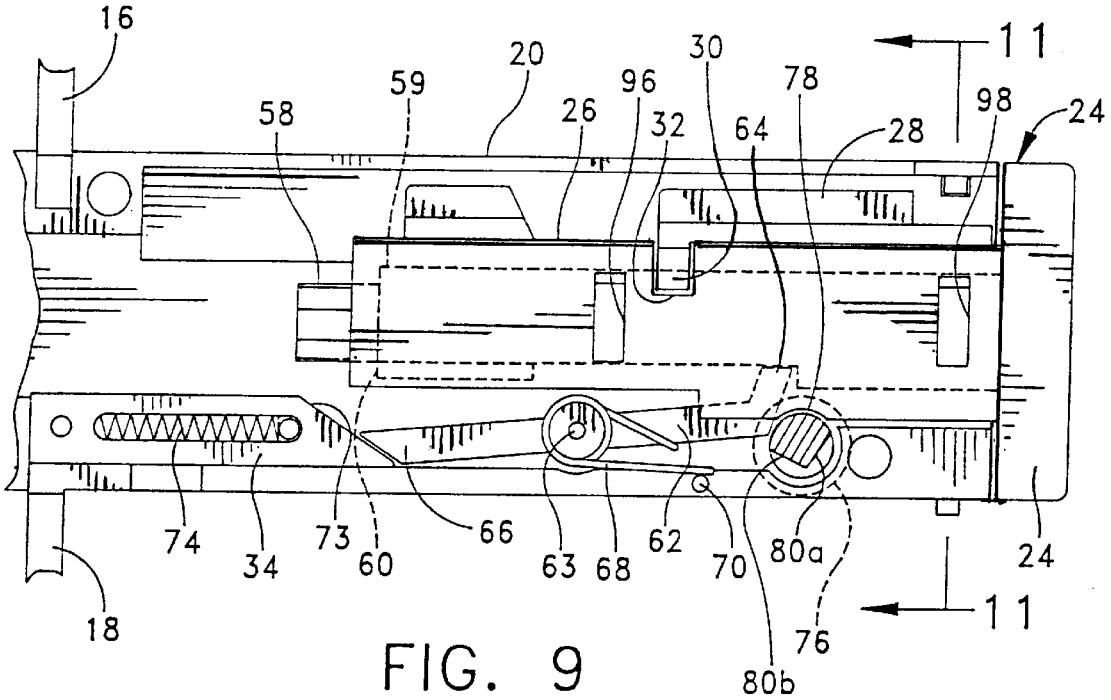
FIG. 9 is a front view of the firing mechanism in accordance with the present invention.
Figure 10:
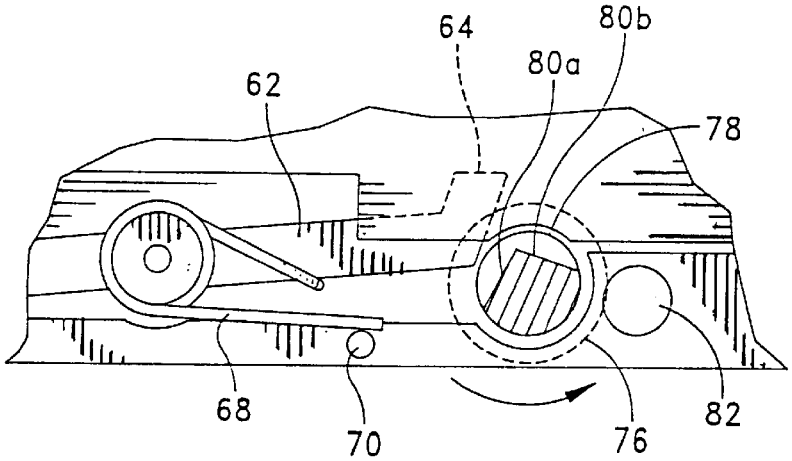
FIG. 10 is a close-up front view of the sear and safety lock assembly in the convertible weapon of the present invention.

Referring now to FIG. 13 and in conjunction with FIGS. 9 and 10, trigger assembly 34 includes a fixed post 72 which resides at the end of slots located on the inner sides of frames 20*a* and 20*b*, and which engages with trigger spring 74 by depression of trigger button 18. Sear 62 is provided at fixed pivot 63 with a tip end 64 and cam surface 66. The sear 62 is spring-biased with its tip 64 in an upward position by engagement of wire spring 68 with fixed post 70. Rotating safety lock assembly 76 includes a rounded surface 78 and cut-out surfaces 80*a* and 80*b*. When safety knob 76 is rotated with rounded surface 78 in an upward position adjacent to sear tip 64, sear tip 64 will be immobilized thus preventing the firearm from firing. In this upward position, bolt carrier tubular member 26 is likewise locked in place as is trigger assembly 34. As seen in sectional drawing FIG. 10, rotation of safety knob 78 approximately 180° from that in FIG. 9, which has left frame 20*a* removed for clarity, orients angled surface 80 adjacent to sear tip 64 to allow sear tip 64 to move downwardly and, thus, permitting firing of the sidearm. This position also orients cut-out surface 80*b* to unlock the safety from bolt carrier tubular member 26. As can be understood, this safety knob configuration 76 is one of many safety configurations that may be employed in accordance with the present invention.

Figure 14:
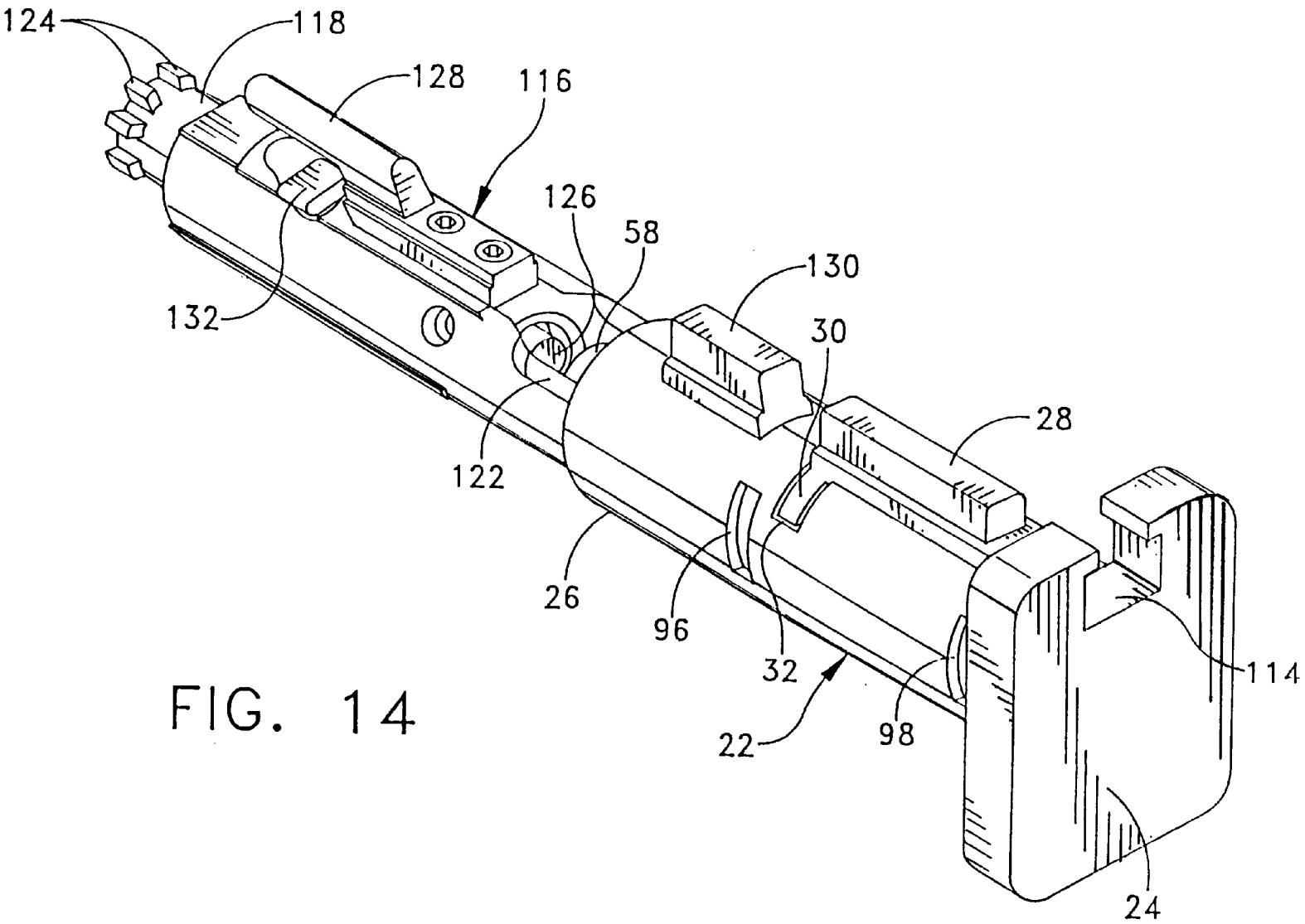
FIG. 14 is a perspective view of the bolt carrier and bolt carrier support assembly.

Referring now to FIGS. 9, 13 and 14, the engagement of a bolt carrier assembly 116, in this case from a U.S. M-16 rifle with bolt carrier support assembly 22, is shown. Bolt carrier support assembly 22 includes a back plate 24 and a tubular member 26 connected thereto. The front slots 96 and rear slots 98 are provided on opposing lateral sides of tube 26. A striker tube 59 is provided within tube 26 which houses a spring-loaded striker 58. The rear half of bolt carrier 116, as best seen in FIG. 14, resides within tube 26. Key members 28, 130 are provided on the top of tube 26 as well as key member 128 on bolt carrier 116 for rotationally orienting bolt carrier 116 and bolt carrier support member within frame 20. In addition, spring-biased lock tab 30 resides within carrier support tube slot 32 to engage with bolt carrier shoulder 122 upon full insertion of bolt carrier 116 within tube 26. Once bolt carrier 116 is installed within bolt carrier support assembly 22, bolt carrier 116 and bolt carrier support assembly 22 move as a single unit, with striker tube 59 now secured in place within the rear of bolt carrier 116, as best seen in FIG. 14.

Figure 11:
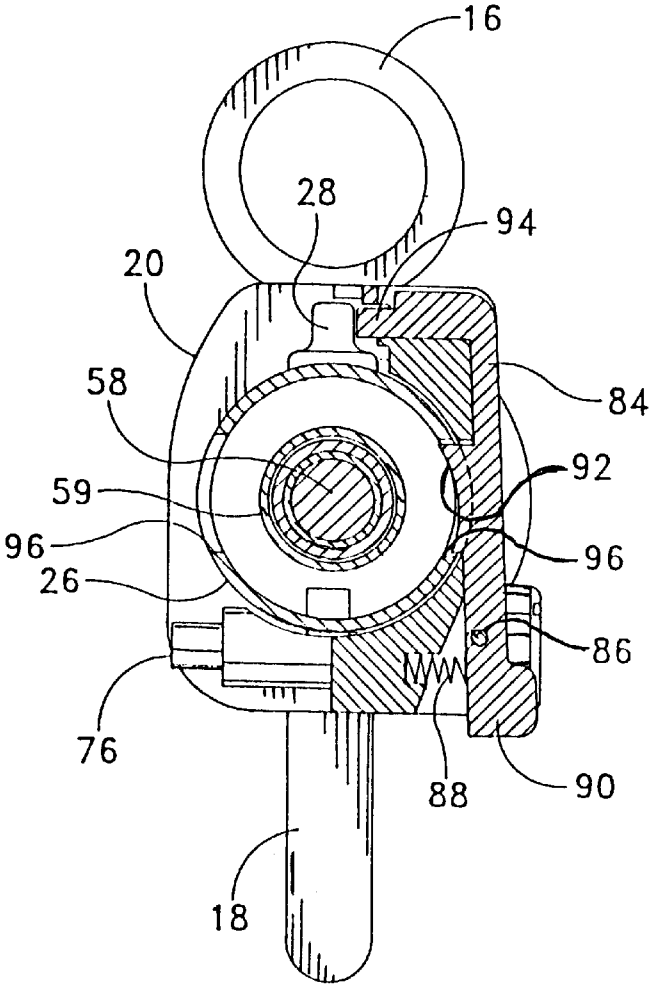
FIG. 11 is a cross-sectional view through the line 11—11 of FIG. 9.
Figure 15:
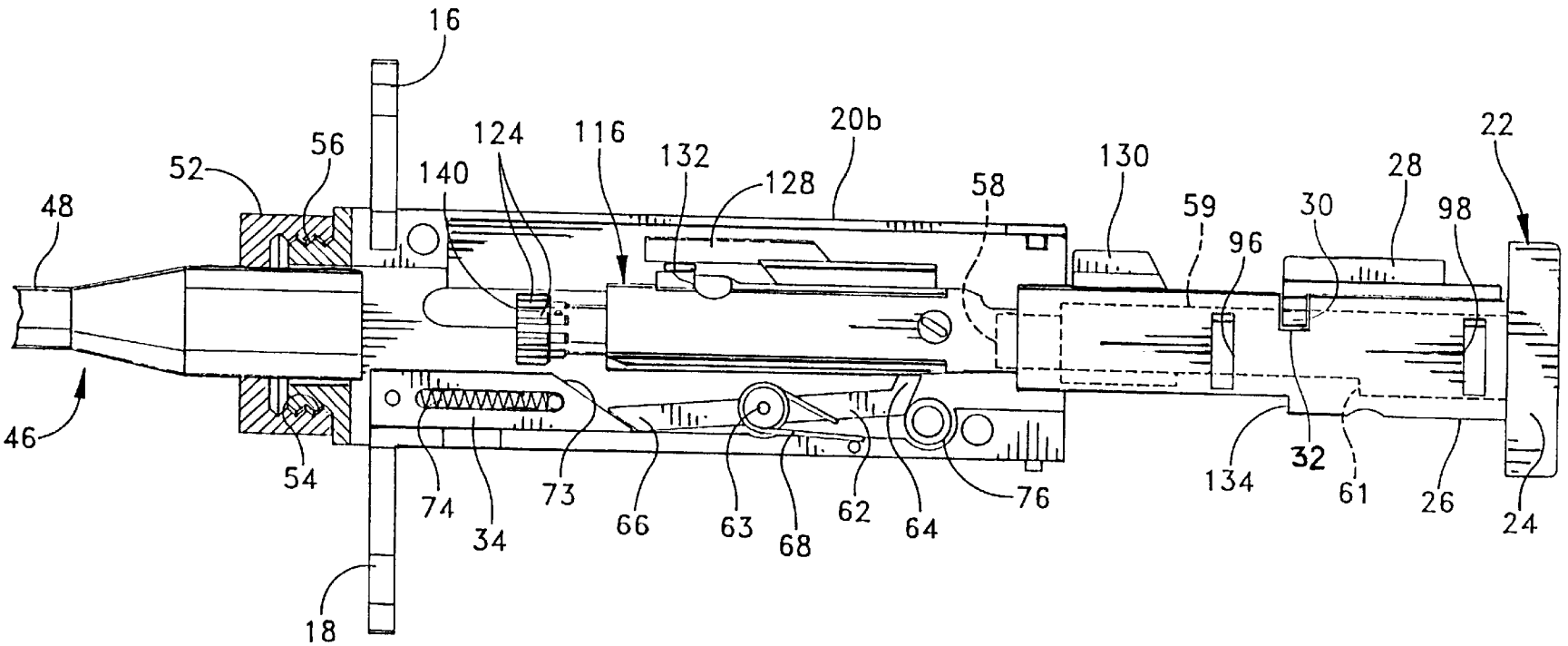
FIG. 15 is a cross-sectional view of the firing assembly of the present invention, with left body frame removed, illustrating initial installation of the bolt carrier and extension housing assembly into the handle of the weapon.

The loading and cocking of the present invention when in a firearm configuration is shown in detail in FIGS. 15–18. In addition, FIGS. 11 and 12 illustrate the use of spring-biased locking clips 84 to retain the combined bolt carrier 116 and bolt carrier support assembly in place. More specifically, FIGS. 15–18 illustrate the steps of preparing and firing the convertible weapon 10 of the present invention. Referring first to FIG. 15, bolt carrier 116 and bolt carrier support assembly 22 are connected together as shown in FIG. 14. The combined unit is then inserted into the substantially tubular cavity formed by half cavities 100*a* and 100*b* provided when frames 20*a* and 20*b* are mated and installed together. It is preferred that left frame 20*a* and right frame 20*b* remained assembled to form an entire substantially tubular frame at all times. Disassembly of frames 20*a* and 20*b* is only required for cleaning or maintenance of the weapon.

Still referring to FIG. 15, the combination structure of bolt carrier 116 and bolt carrier support assembly 22 is inserted into frame 20. As seen in connection with FIG. 13, bolt carrier 116 also includes bolt 118 with locking lugs 124 and bolt face 140. Firing pin 126 is also provided. Bolt cam pin 132, which is moveable between a front and rear position, is also provided. Upon installing the combined bolt carrier 116 and support assembly 22, bolt cam pin 132 is in a forward position with bolt extended. The further insertion of combined assemblies 116 and 22 engages a cartridge 144, which has previously been inserted into the chamber of barrel 46, locking bolt 118 to barrel 46 in preparation for firing.

Figure 16:
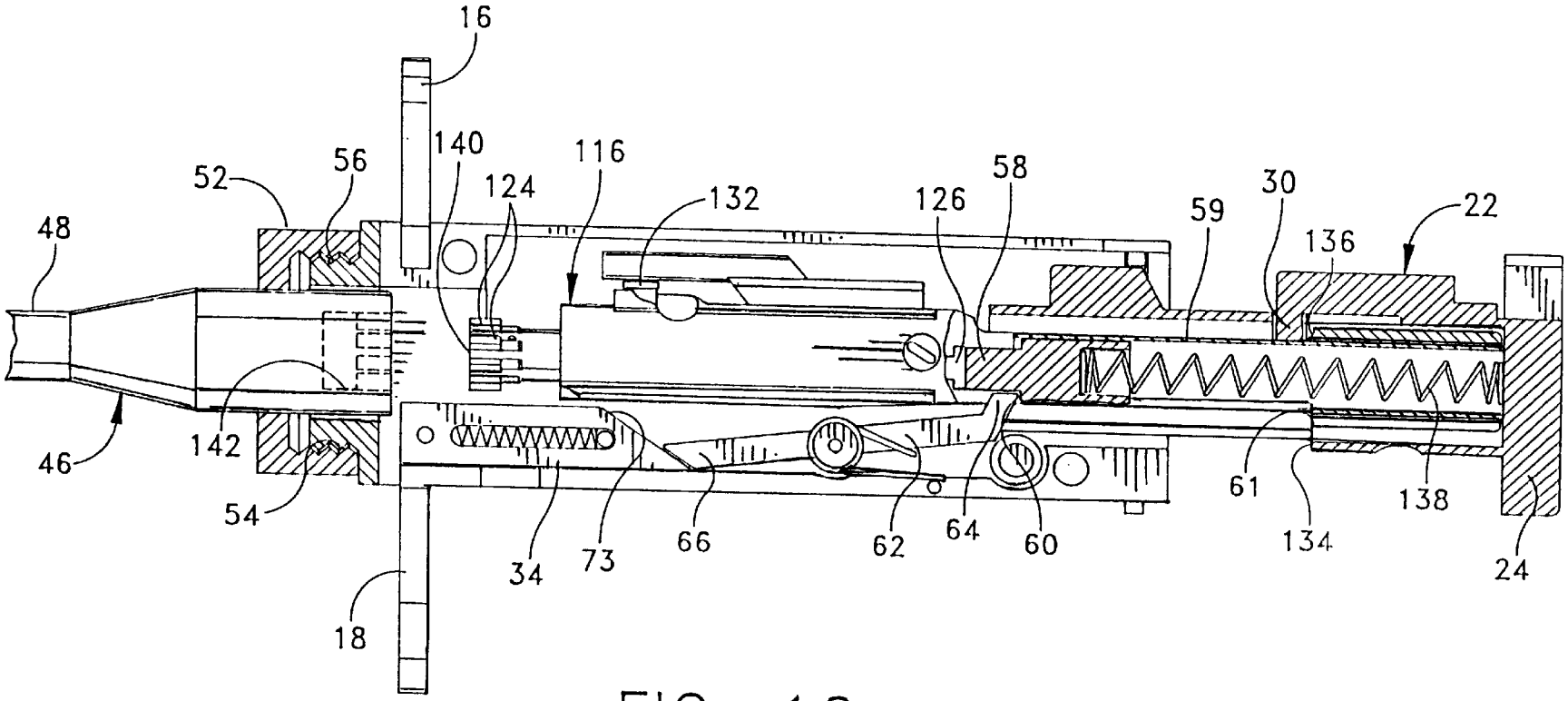
FIG. 16 is a cross-sectional view of the firing assembly of the present invention illustrating initial contact of the sear and the spring-loaded striker of the bolt carrier support assembly.
Figure 17:
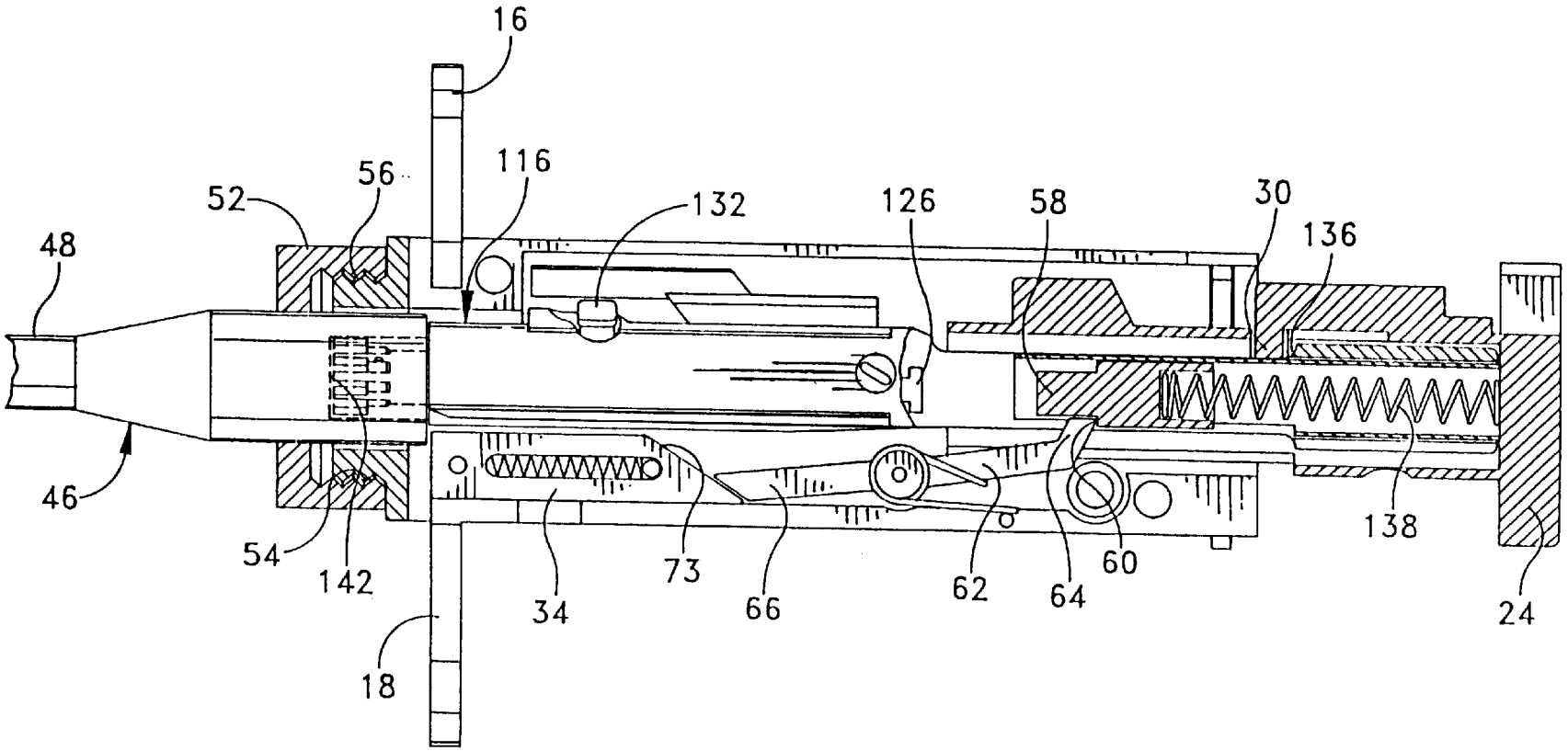
FIG. 17 is a cross-sectional view of the firing assembly of the present invention illustrating the spring-loaded striker of the bolt carrier in a cocked position.

FIG. 16 illustrates further installation of bolt carrier 116 and support assembly 22 so that sear tip 64 engages with spring-loaded striker 58 compressing coil spring 138. Still further, installation of bolt carrier 116 and support assembly 22 causes striker 58 to be drawn back against the forces of coil spring 138 as seen in FIG. 17. As a result, striker 58 is drawn away from firing pin 126 within bolt carrier 116. The bolt carrier 116 is urged into frame 20 so that bolt 118 locking lugs 124 engage with barrel locking channels 142 of barrel 46 to securely lock bolt face 140 to the base of barrel 46 to seal the barrel chamber for firing. The circular locking motion of bolt 118 with locking lugs 124 is effected by bolt cam pin 132 which rides into a cam slot cut into the side of left half frame 20*a* to turn bolt 118 as bolt carrier 116 is moved forward. During the preparation for firing of the weapon, striker 58 is drawn back by the sear tip 64 riding through an elongated channel 61 in the bottom portion of tube 59. In addition, an elongated channel 134 is provided in the bottom portion of tube 26 to permit sear tip 64 to travel within tube 26 to effectuate the compression of striker spring 138 with striker 58 within striker tube 59. Essentially, channels 61 and 134 provide a pass through for striker 58 and sear tip 64 during the preparation for firing.

Figure 18:
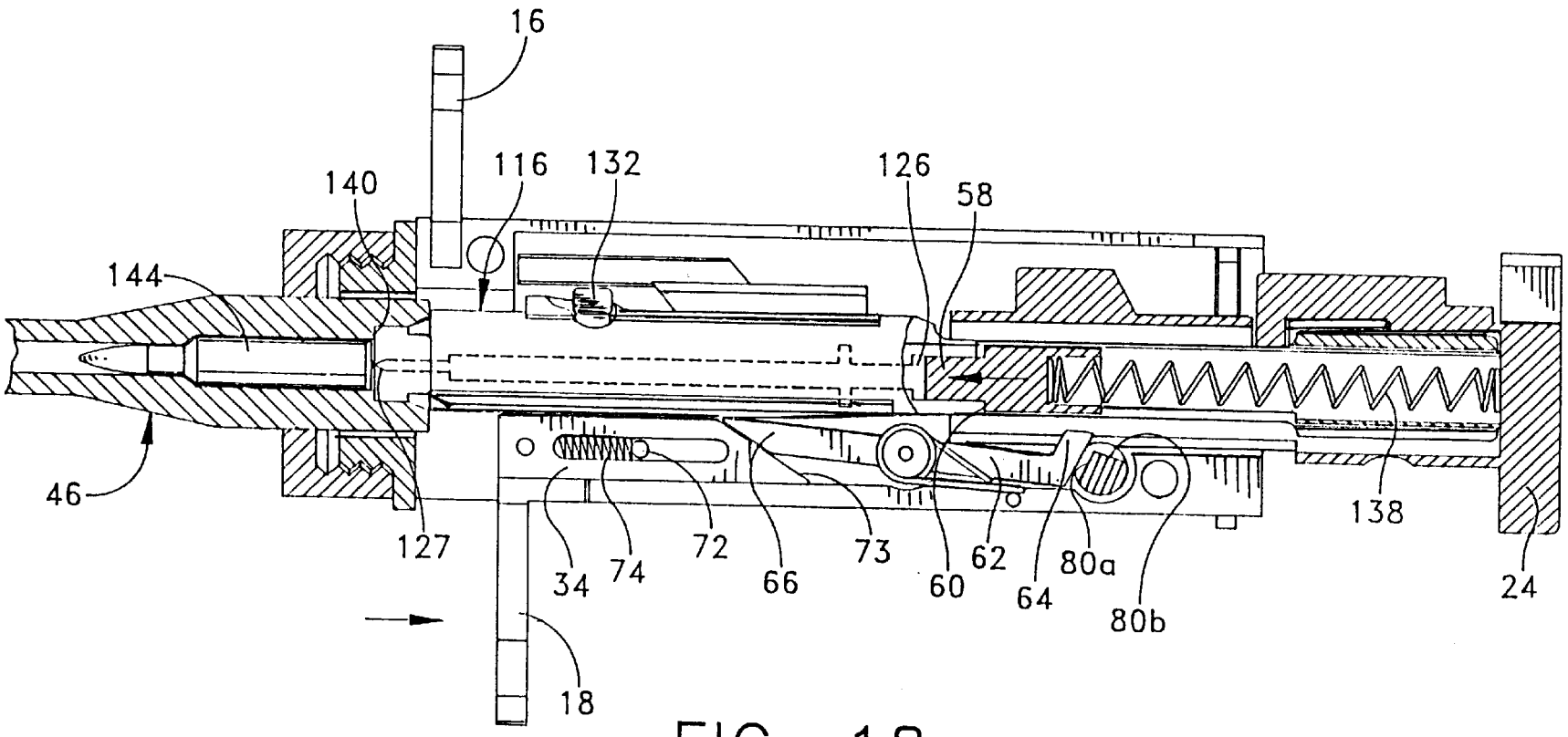
FIG. 18 is a cross-sectional view of the firing assembly of the present invention illustrating firing of the weapon.

The firing of the weapon 10 of the present invention is carried out through the communication of striker 58 with firing pin 126 which, in turn, communicates with cartridge 144 to fire the weapon and launch the bullet. More specifically, trigger assembly 34 is employed by, as shown in FIG. 18, moving trigger button 18 rearwardly against the forces of trigger spring 74 and sear spring 68 to urge trigger cam surface 73 against sear cam surface 66 to, in turn, lower sear tip 64 off striker seat 60. As a result, striker 58 will hit firing pin 126 for immediate firing of the weapon with the assistance of coil spring 138.

The bolt carrier support assembly 22 may be secured in a front position and a rear position. As the combination assembly of bolt carrier 116 and bolt carrier support assembly 22 is inserted into frame 20, spring-biased locking clips 84, as best seen in FIGS. 11 and 12 are employed to maintain combined assemblies 116 and 22 in a desired front position for firing of the firearm. As seen in FIG. 13, front slots 96 and rear slots 98 are provided to engage with side tabs 92. The locking clips 84 are secured to frame 20 via a fixed pivot pin 86 and are spring-biased into a closed position via coil spring 88. It should be understood that for clarity purposes only, the right spring clip 84 is shown to simplify description thereof. It should be understood that an identical, mirror image left spring clip 84 is also provided.

When pinch tabs 90 are depressed, spring clips 84 are opened to lift intermediary tabs 92 and top tabs 94 from their respective resting positions. In particular, pinch tabs 90 are employed whenever it is necessary for intermediary tabs 92 and top tabs 94 are required to engage with another structure. For example, during the installation of the combination structure of bolt carrier 116 and support assembly 22, spring clips 84 must be opened to permit the installation of bolt carrier 116 and support assembly 22 within frame 20. Since, as described above, intermediary tabs 92 engage with either front slots 96 or rear slots 98, once support assembly 22 is positioned so that intermediary tabs can engage with either front slots 96 or rear slots 98, pinch tabs 90 can be released to secure support assembly 22 relative to frame 20. Top tabs 94 are utilized to attach or remove sidearm 10 when in a bayonet configuration with blade attached, from a bayonet lug located beneath the barrel of a service rifle. When safety lock assembly 76 is moved to its upward locking position, it engages circular cut 27 in the base of bolt carrier support tube 26 as shown in FIG. 7. Safety lock assembly 76 thereby secures assembly 22 in place when pinch tabs 90 are depressed and intermediary tabs 92 are lifted along with top tabs 94 when sidearm 10, in a bayonet configuration, is being attached to a rifle.

The foregoing is particularly important during the preparation of the weapon for firing, as in FIG. 17, because spring clips 84 will engage with front slots 96 to maintain the spring forces of 138 to striker 58 on sear tip 64. In the alternative, when the convertible sidearm 10 of the present invention is in a knife configuration, carrier assembly 22 is fully installed within frame 20 to provide a compact knife handle with secure end pommel. This can be accomplished because in this configuration no bolt carrier 116 is installed within support assembly 22. As a result, support assembly 22 is secured to frame 20 via the engagement of spring clips 84 with rear slots 98 in tube 26.

Figure 19:
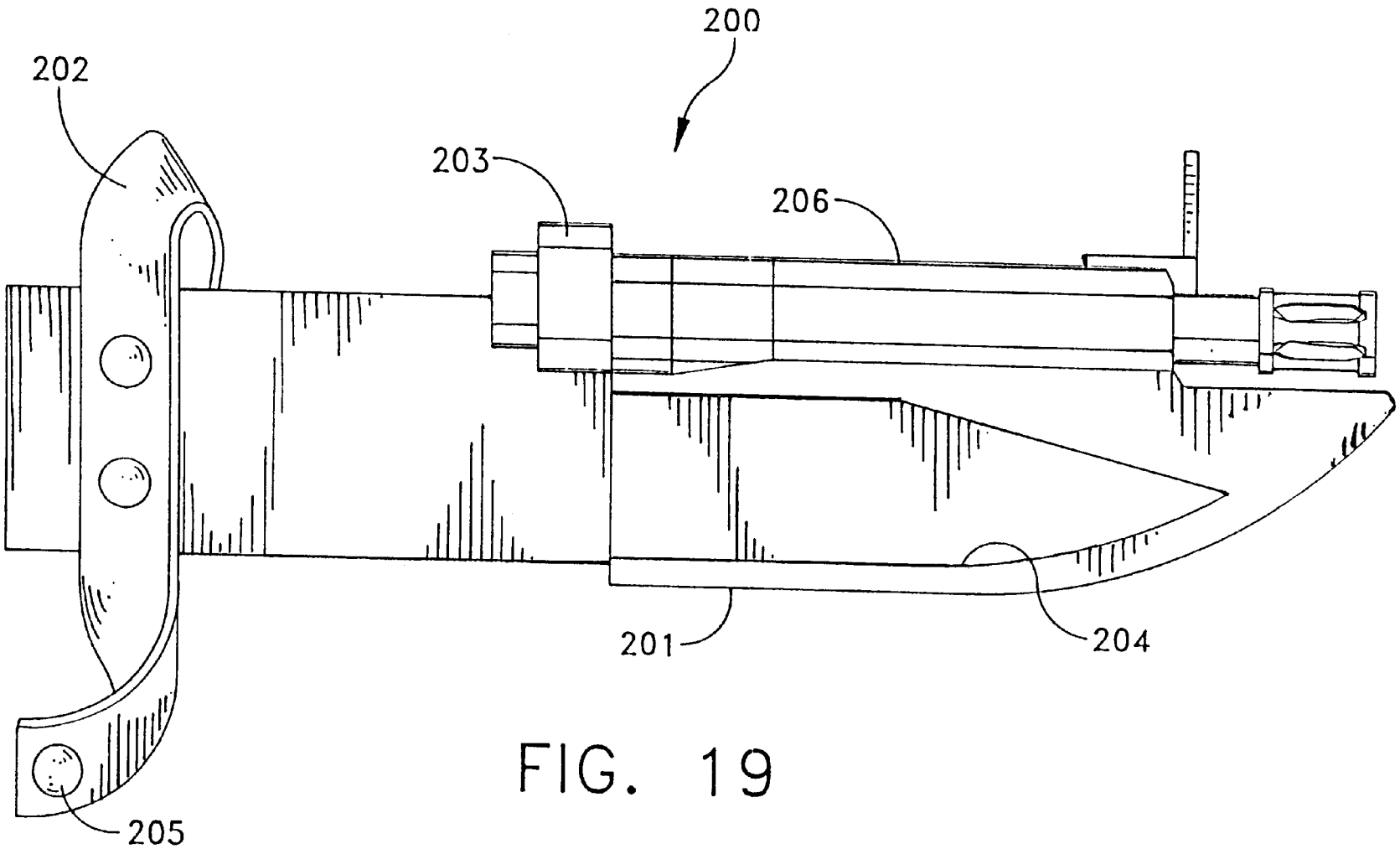
FIG. 19 is a side view of a knife scabbard with a firearm barrel incorporated in the knife scabbard in accordance with the present invention.

Referring now to FIG. 19, a scabbard 200 may be provided in accordance with the present invention. In particular, scabbard 200 includes an appendage 201 having a blade receptacle 204. When not in use, as after sidearm 10 has been converted to a firearm configuration, blade member 14, as shown in FIG. 1, may be detached from body 12 and housed within receptacle 204. In addition, the scabbard 200 of FIG. 19 provides a firearm barrel 206 which is molded directly, or otherwise held, within scabbard 200. Strap 202 holds sidearm 10 in scabbard 200 when configured as a knife or bayonet by being wrapped around handle 20 with ends of strap 202 secured together by snaps or buttons 205. FIG. 19 and the scabbard 200 of the present invention clearly illustrate the use of the present invention as a convertible weapon where the weapon can only function as a knife or as a firearm. The barrel 206 is molded directly within pouch body 201 with a connection portion 203 of the firearm barrel being exposed to permit connection of the barrel to the handle body 12 even while scabbard appendage 201 remains connected thereto. This integrated barrel and scabbard configuration prevents loss of and provides easy access to the firearm barrel 206.

Figure 20:
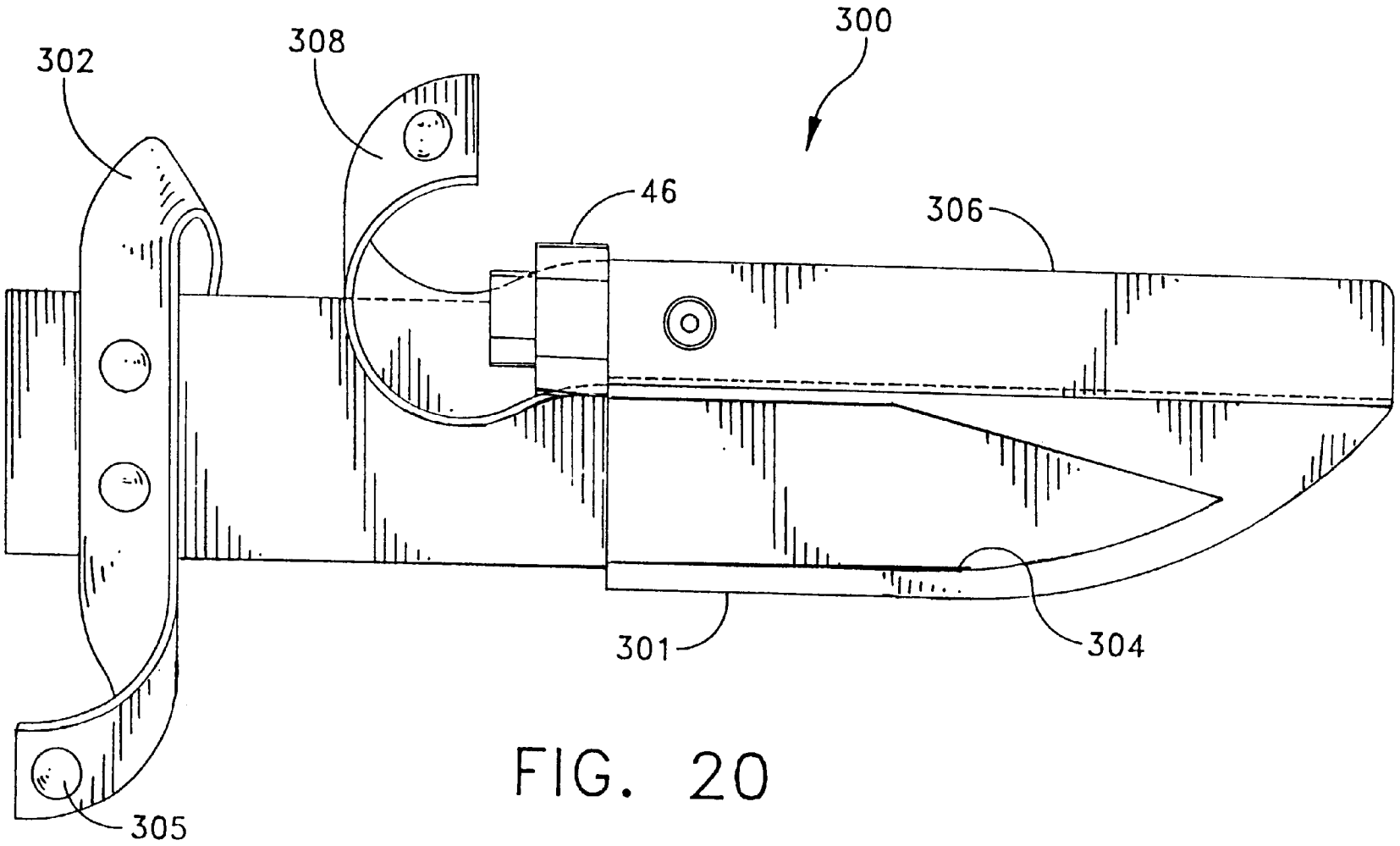
FIG. 20 is an alternative embodiment of the scabbard at FIG. 19 in accordance with the present invention.

FIG. 20 illustrates an alternative embodiment of the scabbard of FIG. 19. Scabbard 300 includes a pouch body 301 with a blade receptacle 304 which functions as described in connection with FIG. 19. In addition, a barrel pouch 306 is provided for receiving a separate firearm barrel 46 as seen in FIG. 8, for example. Firearm barrel 46 is housed within barrel pouch 306 and retained therein by a snap closure 308. Strap 302 holds sidearm 10 in scabbard 300 when configured as a knife or bayonet by being wrapped around handle 20 with ends of strap 302 secured together by snaps or buttons 305.

Figure 21:
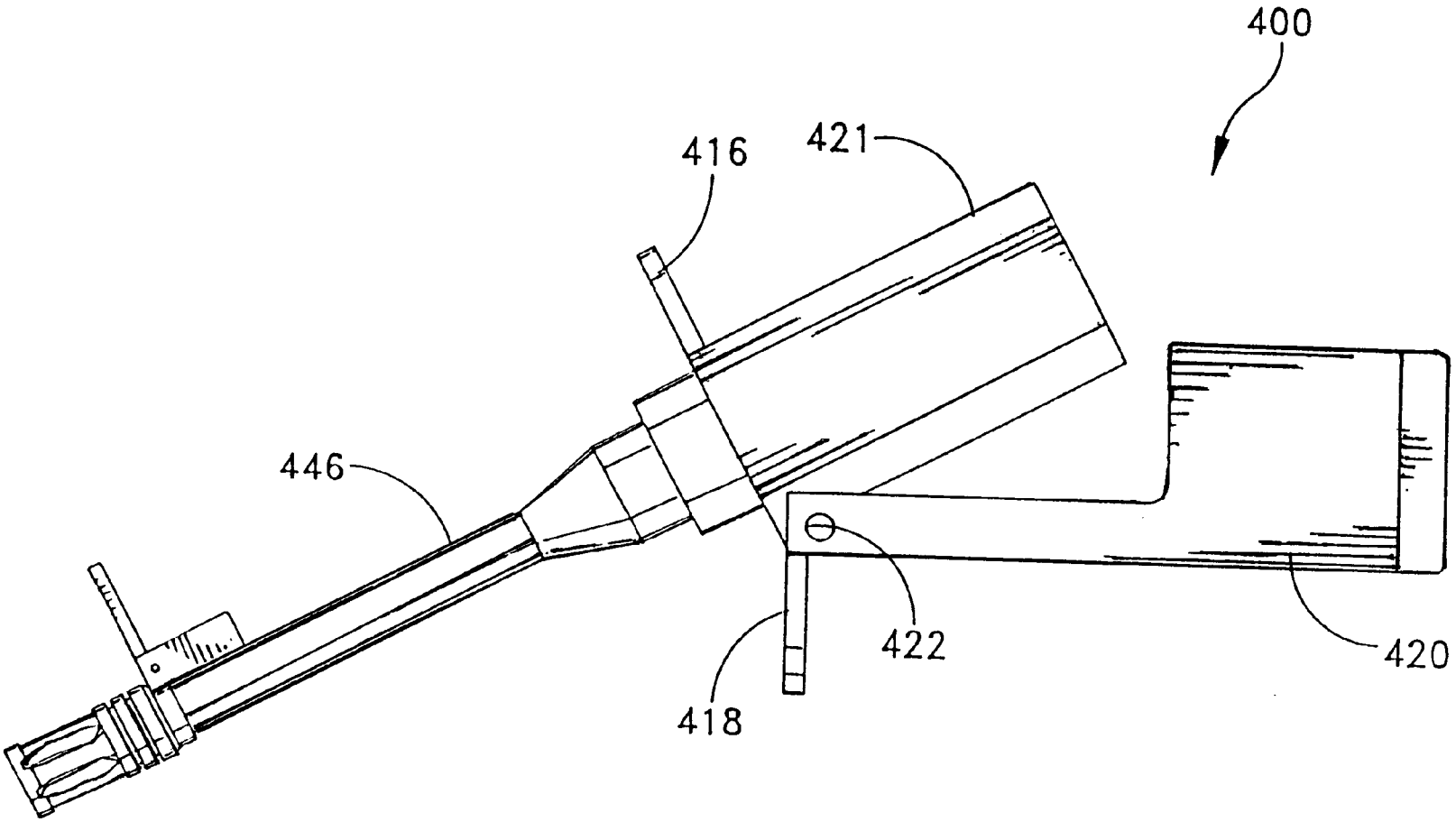
FIG. 21 is an alternative embodiment of the present invention with a shotgun-style break-open action.
Figure 22:
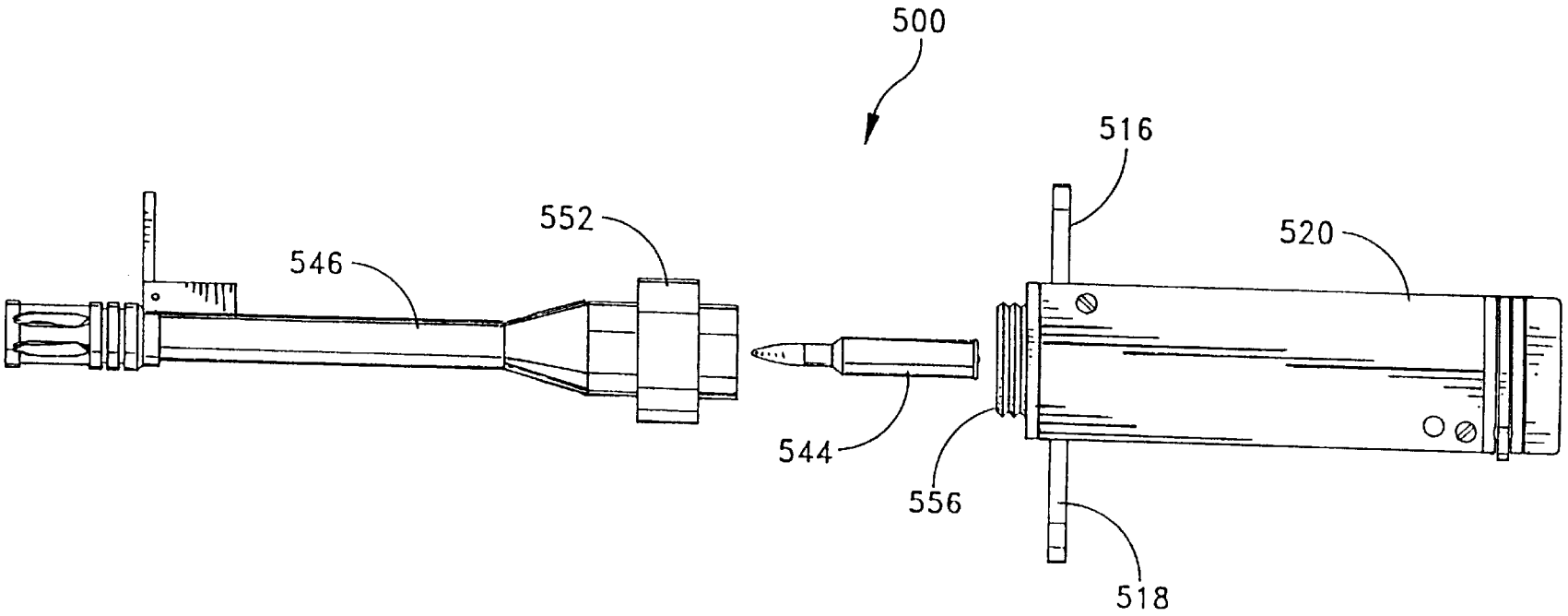
FIG. 22 is another alternative embodiment of the present invention with a direct ammunition loading configuration.

Turning now to FIGS. 21 and 22, alternate breech mechanism embodiments are shown of the convertible sidearm invention which do not require the addition of a bolt or bolt carrier assembly during conversion to a firearm configuration. In particular, FIG. 21 illustrates an alternative configuration 400 in which a break-open or tip-up style breech mechanism design is employed. Barrel 446 may be permanently connected to cartridge-receiving body 421 or connected via a locking collar as shown and described in connection with the preferred embodiment of the present invention. Trigger 418 is provided and functions in similar fashion as described above. Also, FIG. 22 illustrates yet a further alternative breech mechanism design 500 where no ejection or cartridge installation or removal port 102 is provided. In this embodiment, cartridge 544 is first installed within barrel 546 prior to connection of barrel 546 to body frame 520 via locking collar 552 and threaded neck 556. Trigger 518 and sight 516 are provided in similar fashion to as described above. In embodiments 400 and 500 of FIGS. 21 and 22, the sidearm handle contains a complete firearm mechanism. To convert sidearm 10 from a knife or bayonet to a firearm only requires removal of the blade assembly and replacement with a barrel assembly without the need for adding an additional bolt assembly. Similarly, an alternative embodiment of sidearm 10 could consist of a design in which a bolt assembly is permanently contained within body handle 12.

In particular, the convertible sidearm 10 of the present invention is unique in that it preferably employs a bolt carrier or bolt assembly which is withdrawn and used from another firearm such as a rifle. The ability to use a core component such as a bolt carrier within the convertible weapon of the present invention saves cost and valuable weight, particularly in a military application where weight of equipment is of particular concern. The present invention may accommodate a wide array of ammunition such as rifle, shotgun and pistol ammunition as well as tracer ammunition, flares, grenades, signal cartridges and noise cartridges. As seen in FIG. 1, bayonet catch 114 is provided to permit the easy mounting of the present invention, when in a knife configuration, to an existing rifle to act and serve as a bayonet. Likewise, sight 16 and the circular aperture therethrough, is utilized for forward mounting of sidearm 10 to a rifle for bayonet purposes It will be appreciated by those skilled in the art that various changes and modifications can be made to the illustrated embodiments without departing from the spirit of the present invention. All such modifications and changes are intended to be covered by the appended claims.

What is claimed is:

1. A method for converting a convertible weapon from a blade weapon to a firearm weapon, comprising the steps of:

providing a substantially tubular body frame with a longitudinal axis and having a first open end and a second open end;

providing a first connection means at said first open end;

providing a second connection means at said second open end;

connecting a blade assembly to said tubular body frame at said second open end via said second connection means;

removably affixing a back plate member assembly to said substantially tubular body frame at said first open end via said first connection means;

providing said back plate assembly with a substantially tubular support member emanating outwardly from a planar surface of said back plate member assembly;

removing said blade assembly from said tubular body frame;

providing a bolt carrier assembly within said tubular support member of said back plate member assembly; said bolt carrier assembly including a bolt, having a cartridge receiving end, and a firing pin configured for slidable displacement within said bolt carrier assembly from a first, rearward, position whereat said firing pin is recessed relative to said cartridge receiving end to a second, forward, position whereat said firing pin is capable of extending beyond said cartridge receiving end; said firing pin being secured to the forward end of said bolt carrier assembly;

providing a spring-biased sear in said tubular body frame;

providing a spring-loaded striker in said back plate assembly;

positioning said spring-loaded striker proximal to said bolt;

affixing a barrel, having a base, to said substantially tubular body frame via said base and at said second opening via said second connection means;

removing said back plate member assembly from said tubular body frame;

installing said bolt carrier assembly in said substantially tubular support member of said back plate member assembly;

installing a cartridge, including a bullet therein, in said barrel;

inserting said bolt carrier assembly and said back plate assembly into said tubular body frame via said first open end;

engaging said sear with said striker;

retracting said striker upon insertion of said bolt carrier assembly into said tubular body frame;

securing said back plate assembly to said tubular body frame via said first connection means;

providing a combination trigger and knife guard member;

depressing said trigger and knife guard member;

disengaging said sear from said striker;

striking said firing pin with said striker;

striking said cartridge with said firing pin;

firing said bullet; and ejecting said cartridge out of said tubular body frame.

2. The method of claim 1, wherein said second connection means comprises a locking collar.

3. The method of claim 1, wherein said convertible weapon is convertible from a firearm weapon to a blade weapon.

4. The method of claim 1, wherein said bolt carrier assembly is a rifle bolt carrier assembly.

5. The method of claim 1, wherein said bolt carrier assembly is a standard bolt assembly from a primary weapon.

6. The method of claim 1, further comprising the following steps:

providing a scabbard having a blade pouch capable of housing said blade member; and affixing said barrel to said scabbard.

7. The method of claim 1, further comprising the following steps:

providing a scabbard;

providing a blade pouch in said scabbard for housing said blade member; and providing a barrel pouch in said scabbard for housing said barrel.

8. The method of claim 1, wherein said barrel is of a break-open shotgun configuration.

* * * * *